US006702924B2

(12) United States Patent
Beck

(10) Patent No.: US 6,702,924 B2
(45) Date of Patent: Mar. 9, 2004

(54) MAIN ROLL FOR AN AIR PRESS OF A PAPERMAKING MACHINE

(75) Inventor: David A. Beck, Appleton, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/965,016

(22) Filed: Sep. 27, 2001

(65) Prior Publication Data

US 2003/0056922 A1 Mar. 27, 2003

(51) Int. Cl.[7] ..... D21F 3/08

(52) U.S. Cl. ..... 162/205; 167/360.3; 100/155 R; 492/58

(58) Field of Search ..... 162/205, 206, 162/358.1, 358.2, 358.3, 358.4, 358.5, 359.1, 360.2, 360.3, 361, 374; 492/3, 20, 26, 27, 35–40, 47, 48, 57–60; 100/47, 118, 161, 162 R, 155 R, 168–170, 176; 34/115, 111, 122, 124, 607, 242

(56) References Cited

U.S. PATENT DOCUMENTS

| | | | | | |
|---|---|---|---|---|---|
| 824,848 | A | * | 7/1906 | Corwin | 492/40 |
| 1,837,925 | A | * | 12/1931 | Thompson | 492/40 |
| 2,280,208 | A | * | 4/1942 | Wilkie | 100/176 |
| 2,720,691 | A | * | 10/1955 | Kuniholm | 29/252 |
| 3,106,767 | A | * | 10/1963 | Fox | 226/192 |
| 3,315,370 | A | * | 4/1967 | Hikosaka | 100/118 |
| 4,173,249 | A | * | 11/1979 | Holkko et al. | 100/118 |
| 4,675,079 | A | * | 6/1987 | Webster | 100/118 |
| 4,864,704 | A | * | 9/1989 | Hogan et al. | 193/37 |
| 5,564,196 | A | * | 10/1996 | Nomura et al. | 162/273 |
| 6,374,494 | B1 | * | 4/2002 | Sonobe et al. | 29/895.213 |

FOREIGN PATENT DOCUMENTS

| | | | |
|---|---|---|---|
| EP | 0 613 729 | 9/1994 | B05D/1/40 |
| EP | 1 088 933 A2 | 4/2001 | D21F/3/02 |
| EP | 1 088 934 | 4/2001 | D21F/3/02 |

* cited by examiner

*Primary Examiner*—Peter Chin
*Assistant Examiner*—Eric Hug
(74) *Attorney, Agent, or Firm*—Taylor & Aust, P.C.

(57) ABSTRACT

A roll for use in an air press assembly of a papermaking machine has a pair of ends associated therewith. The roll includes a pair of edge portions with each edge portion extending to one of the pair of ends. Each edge portion has an edge surface portion composed of a first material, the first material having a first hardness. The roll further includes a middle portion located between the pair of edge portions, the middle portion having a middle surface portion composed of a second material. The second material has a second hardness, the second material being harder than the first material. The first material is preferably a soft, seal material which promotes reduced air leakage from the air press assembly.

15 Claims, 2 Drawing Sheets

MAIN ROLL FOR AN AIR PRESS OF A PAPERMAKING MACHINE

STATEMENT REGARDING FEDERALLY SPONSORED RESEARCH OR DEVELOPMENT

This invention was made with Government support under Prime Contract No. DE-FC36-01GO10622 awarded by the Department of Energy. The Government has certain rights in this invention.

BACKGROUND OF THE INVENTION

1. Field of the Invention

The present invention relates to air press assemblies of papermaking machines, and, more particularly, to rolls used in such air press assemblies.

2. Description of the Related Art

For many years attempts have been made to use external air pressure to force water out of a paper web. Rather than compress a sheet at a press nip to the point where hydraulic pressure drives water out, as is the case in normal wet pressing, it was reasoned that more water could be removed, and sheet bulk could be maintained, if air pressure could be applied to supplement roll nip generated hydraulic pressures. One such attempt involves providing a multi-roll or other structure forming an air press having a closed chamber, wherein air is circulated through the chamber to convect moisture out of the paper web.

One significant challenge that exists in designing an effective multi-roll air press assembly is in minimizing the leakage of air from the assembly adjacent each set of roll ends, each set of roll ends defining a respective chamber end. Typically, a respective seal assembly is held in tension against each chamber end. However, the opportunity for air leakage from the nip region between respective rolls exists, especially in the end portions of each roll not in contact with the paper web and at least one web transfer fabric being fed therethrough.

Another challenge that exists in designing an effective multi-roll air press assembly is in minimizing the cost, labor and down time associated with the replacement of a worn roll, especially large-diameter main rolls. Even if some type of a surface cover is used in such an instance, replacement involves removing the surface cover from the entire roll length and then placing on a new surface cover. The expense can be increased if the entire roll should instead require replacement.

What is needed in the art is a roll for use in an air press assembly of a papermaking machine that results in decreased air leakage from multi-roll air presses adjacent nip ends thereof, and has readily accessible and replaceable portions which tend to wear for a certain amount of time before any significant wear begins to occur on the primary part of the roll.

SUMMARY OF THE INVENTION

The present invention provides a roll for use in an air press of a papermaking machine which has a hard central section, in order to promote paper web processing, and soft, elastomeric ends, in order to reduce air leakage from the air press.

The invention comprises, in one form thereof, a roll for use in an air press assembly of a papermaking machine, the roll having a pair of ends associated therewith. The roll includes a pair of edge portions with each edge portion extending to one of the pair of ends. Each edge portion has an edge surface portion composed of a first material, the first material having a first hardness. The roll further includes a middle portion located between the pair of edge portions, the middle portion having a middle surface portion composed of a second material. The second material has a second hardness, the second material being harder than the first material.

The invention comprises, in another form thereof, a method of pressing a fiber web using an air press. The method includes the step of providing an air press for pressing a fiber web. The air press includes at least one cap roll including a first cap roll; and at least one main roll including a first main roll, the first cap roll and the first main roll forming a first nip therebetween, each main roll having a pair of ends associated therewith. Each main roll has a pair of edge portions, each edge portion extending to one of the pair of ends. Each edge portion has an edge surface portion composed of a first material, the first material having a first hardness. Each main roll also has a middle portion located between the pair of edge portions, the middle portion having a middle surface portion composed of a second material. The second material has a second hardness, the second material being harder than the first material. The method further includes the steps of forming a seal between the pair of edge portions of the first main roll and the first cap roll and feeding the fiber web through the first nip into the air press.

An advantage of the present invention is that the soft edge portions promote sealing of the respective nips of the plurality of rolls in an air press assembly, thereby reducing air leakage and increasing the effectiveness of the air press assembly.

Another advantage is the soft edge portions, which are replaceable, have a larger average diameter than and thus tend to wear out before the central hard portion, which is not as readily replaced as the soft edge portions. As such, with frequent enough replacement of the soft edge portions, the need for replacing the central hard portion is greatly reduced.

Yet another advantage is that the size of the soft edge portions can be chosen such that each soft edge portion is limited to the area where sealing is required and such that each does not interfere with the conveyance of a fiber web through the air press assembly.

An even farther advantage is that by placing the soft rubber on the edges of each of the larger-diameter main rolls instead of the smaller-diameter cap rolls, the soft rubber has an increased chance for a longer life as there is more chance for cooling, during a rotation, and less nip cycles per minute. Furthermore, more rubber is exposed to metal in each main roll, allowing greater heat transfer and thus better cooling.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
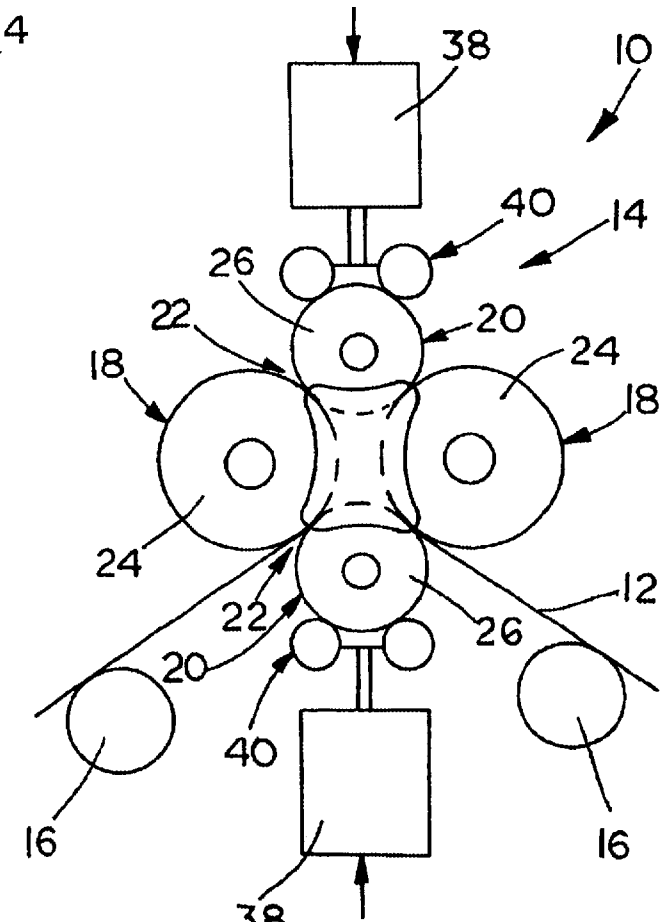
FIG. 1 is a schematic, side view of an embodiment of a papermaking machine of the present invention.

Referring now to the drawings, and more particularly to FIG. 1, there is shown a papermaking machine 10 for processing a web 12 which generally includes an air press 14 and a plurality of conveyor rolls 16, web 12 typically being a fiber web.

Figure 2:
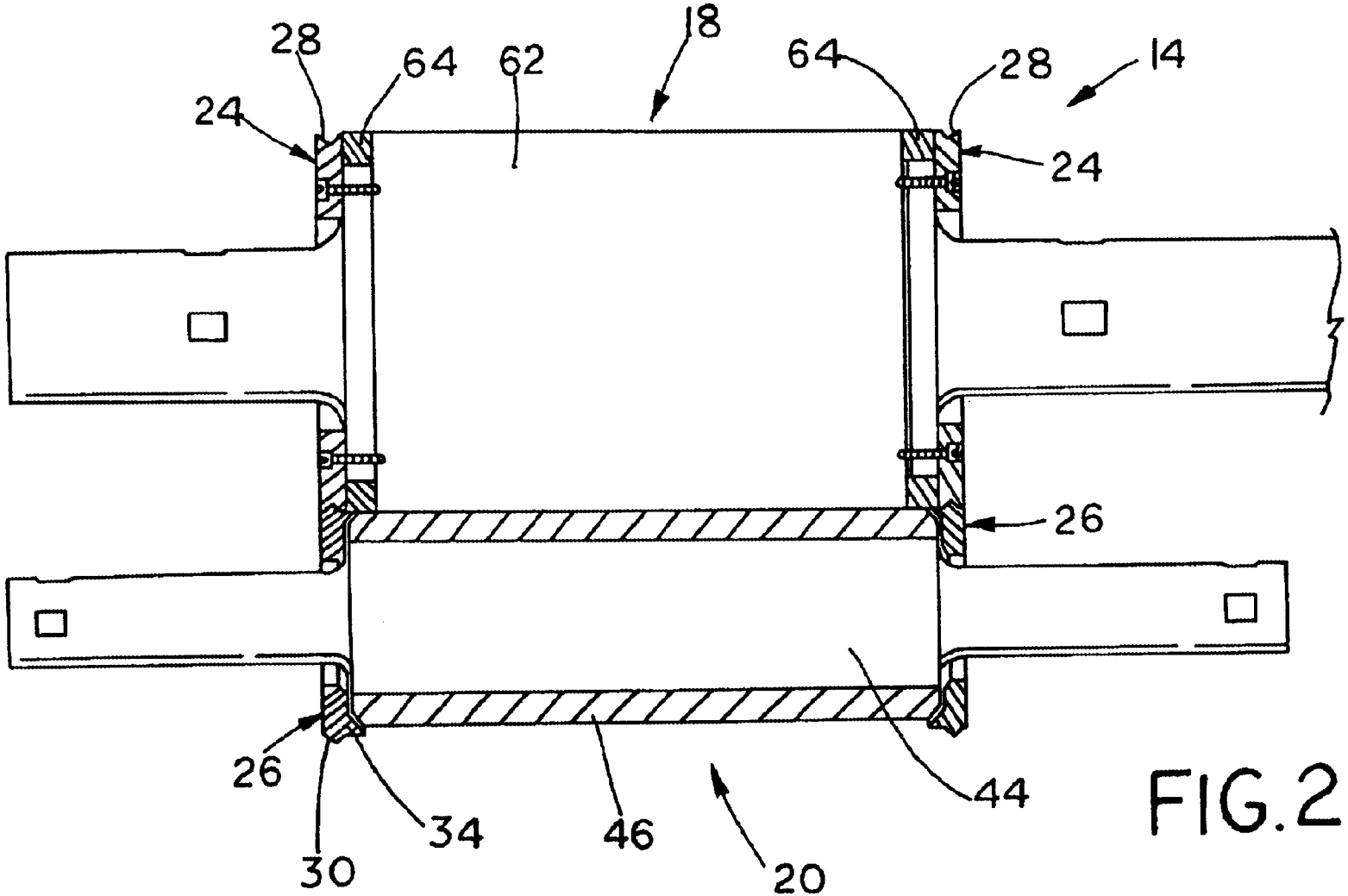
FIG. 2 is a side, partial sectional view of a main roll and an adjoining cap roll shown in FIG. 1.

Air press 14 includes a pair of main rolls 18 and a pair of cap rolls 20 juxtaposed thereto, thereby forming a plurality of nips 22 therebetween. At the very edges of main rolls 18 and cap rolls 20 are mounted bevel plates 24 and cap seal rings 26, respectively. Bevel plates 24 and cap seal rings 26 are provided with a beveled notch 28 (FIGS. 2 and 3) and a beveled key 30, respectively, to permit each set of adjoining bevel plates 24 and cap seal rings 26 to matingly seal and thereby interlock main rolls 18 and cap rolls 20 in a cross-machine direction 32. Cap seal ring 26 further has an orthogonal extension 34 that has a beveled extension end 36 configured to mate with adjoining cap roll 20.

Air press 14 further includes an air cylinder 38 and a corresponding cap seal ring pulleys 40 associated with each cap roll 20; and an end seal arrangement 42 associated with each of the two collective end sets of main rolls 18 and cap rolls 20.

Figure 3:
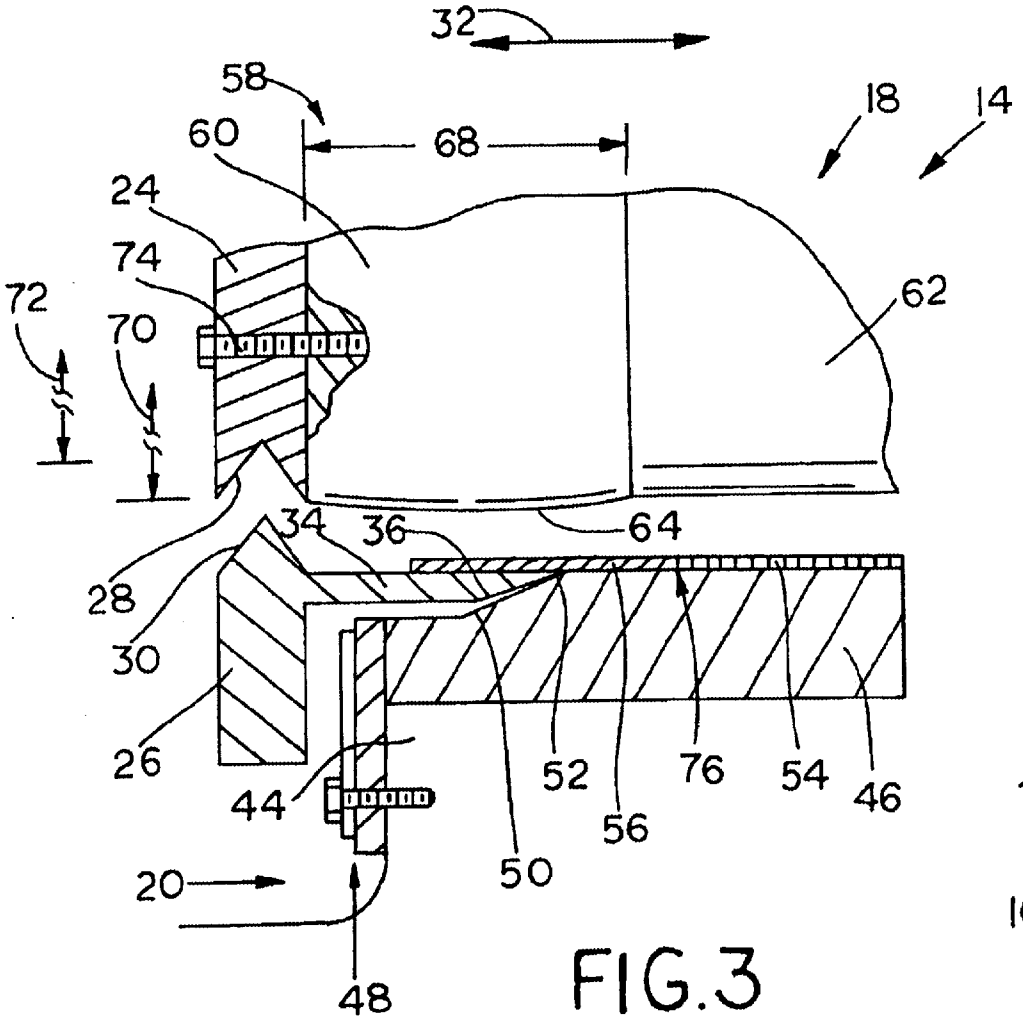
FIG. 3 is a fragmentary, sectional view of a main roll and an adjoining cap roll shown in FIG. 1.

Each cap roll 20 includes a cap roll core 44, a cap roll cover 46 positioned on cap roll core 44 and a pair of cap-end wear assemblies 48 (one of which is shown in FIG. 3). Cap roll core 44 is preferably made of steel or another suitable metal or alloy, and cap roll cover 46 is preferably made of rubber or another elastomeric material. Most preferably, cap roll cover 46 is made of a harder rubber in order to add to cover life and reduce heat buildup therein.

Proximate each end of cap roll 20, cap roll cover 46 has a beveled cover portion 50 that mates with corresponding orthogonal extension 34 of cap seal ring 26 and beveled extension end 36 associated therewith, thereby forming a ring-cover seal 52 therebetween. Cap roll cover 46 is provided with a permeable membrane 54 thereon which may extends over a substantial portion of the length thereof, including the central portion (relative to cross-machine direction (CD direction) 32) thereof. However, near each ring-cover seal 52, cap roll cover 46 instead could have an impermeable membrane 56 attached thereon, impermeable membrane 56 extending across ring-cover seal 52 and onto orthogonal extension 34 of cap seal ring 26. Impermeable membrane 56, when present, helps minimize the leakage through ring-cover seal 52. A sufficient seal can still be obtained, though, even if impermeable membrane 56 is not employed.

Each main roll 18 has a pair of main roll ends 58 (one of which is shown in FIG. 3) and includes at least three portions, relative to cross-machine direction 32. Specifically, each main roll 18 has a pair of edge portions 60 (one of which is shown in FIG. 3) and a middle portion 62. Each edge portion 60 extends to one of main roll ends 58. Middle portion 62 is located between edge portions 60, with edge portions 60 being replaceably mounted thereagainst by bevel plates 24.

Each edge portion 60 has at least an edge surface portion 64 composed of a first material, the first material having a first hardness, and middle portion 62 has a middle surface portion 66 composed of a second material, the second material having a second hardness, the second material being harder than the first. Specifically, the first material preferably is a soft, elastic rubber or other suitable elastomer and has a softness of greater than 10 P & J (P & J is a hardness unit based upon Pusey & Jones standard measurement; plastometer (P&J) readings increase with softer materials; they measure the indentation of a ⅛-inch diameter ball under one kilogram of weight for one minute (see, e.g., the website www.vailrubber.com/roller-coverings.html)) and preferably at least about 100 P & J. Conversely, the second material preferably is one of a steel, a ceramic material, a hard rubber and a hard plastic and has an approximate hardness of between 0 to 20 P & J. Middle surface portion 66 of middle portion 62 crowned to counteract pressure effects.

The size and shape of edge portion 60 and edge surface portion 64 are chosen based upon specific parameters. Edge width 68 needs to extend beyond ring-cover seal 52 in order to achieve sufficient sealing therewith or, if present, with impermeable membrane 56 at nip 22 between main roll 18 and cap roll 20 but favorably should not extend far enough to be juxtaposed to permeable membrane 54 (i.e., so as to have edge portion 60 just in the area it is needed and so as to not interfere with fiber web 12). Edge surface portion 64 must be made to seal the fabric edge despite the air pressure within air press 14. Edge surface portion 64 can be made to give the best sealing, for example, by crowning edge portion 60 during forming and/or by causing edge portion 60 to bulge. As such, when mounted, edge portion 60 has a maximum edge diameter 70 (schematically shown) that is greater than a maximum middle diameter 72 (schematically shown) of middle portion 62. Bevel plate 24 is held onto edge portion 60 by threaded fasteners 74, and tightening thereof can be used to produce a desired bulge in edge surface portion 64. Tightening of bevel plate 24 against edge portion 60 offers the further advantage of placing edge portion 60 under compression, thereby adding to the life of the rubber, as cracks do not tend to propagate in a material placed under compression.

In use, air press 14 is provided for dewatering a fiber web 12. Air press 14 includes at least a first cap roll 20 and at least a first main roll 18, first cap roll 20 and first main roll 18 forming one nip 22 therebetween. Each main roll 18 has a pair of main roll ends 58 associated therewith, and each main roll 18 includes a pair of edge portions 60, each edge portion 60 extending to one of main roll ends 58. Each edge portion 60 has an edge surface portion 64 composed of a first material, the first material having a first hardness and has a middle portion 62 located between edge portions 60, middle portion 62 having a middle surface portion 66 composed of a second material, the second material having a second hardness, the second material being harder than the first material. Sealing between the pair of edge portions 60 of at least first main roll 18 and at least first cap roll 20 is initiated, and fiber web 12 is fed through one nip 22 into air press 14.

One alternate form of the invention includes providing middle portion 62 with a thin soft side (not shown) at each side thereof and adjacent to a respective edge portion 60 in order to act as a further seal for interior edge 76 of impermeable membrane 56.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An air press for removing liquid from a web, said air press comprising:

a plurality of rolls including at least one first roll, each first roll having a pair of ends associated therewith, each first roll comprising:

a pair of edge portions, each edge portion extending to one of said pair of ends, each said edge portion having an edge surface portion composed of a first material; and a middle portion located between said pair of edge portions, said middle portion having a middle surface portion composed of a second material, said second material having a second hardness, said second material being harder than said first material.

2. The air press of claim 1, wherein said plurality of rolls further includes at least one second roll, each second roll being a cap roll, each first roll being a main roll, one cap roll and one main roll forming a first nip therebetween.

3. The air press of claim 1, wherein said first material is a soft material having a softness of greater than about 10 P & J and said second material is a hard material having an approximate softness of between 0 to 20 P & J.

4. The air press of claim 1, wherein said first material is a soft, elastic rubber, said second material being one of a steel, a ceramic material, a hard rubber, and a hard plastic.

5. The air press of claim 1, wherein each said edge surface portion is configured to wear at a faster rate than said middle surface portion.

6. The air press of claim 1, including at least one of a juxtaposed roll and an impermeable membrane associated with a juxtaposed roll; wherein each edge surface portion is configured for forming a seal with said at least one of a juxtaposed roll and an impermeable membrane associated with a juxtaposed roll.

7. An air press assembly roll, for sealing an air press pressure chamber in a papermaking machine, said roll having a pair of ends associated therewith, said roll comprising:

a pair of edge portions, each edge portion extending to one of said pair of ends, each edge portion having an edge surface portion composed of a first material, said first material having a first hardness; and a middle portion located between said pair of edge portions, said middle portion having a middle surface portion composed of a second material, said second material having a second hardness said second material being harder than said first material;

wherein each edge surface portion is configured to wear at a faster rate than said middle surface portion and has a maximum mounted edge surface portion diameter, said middle surface portion having a maximum mounted middle surface portion diameter, said maximum mounted edge surface portion diameter being greater than said maximum mounted middle surface portion diameter.

8. An air press assembly roll, for sealing an air press pressure chamber in a papermaking machine, said roll having a pair of ends associated therewith, said roll comprising:

a pair of edge portions, each edge portion extending to one of said pair of ends, each edge portion having an edge surface portion composed of a first material, said first material having a first hardness; and a middle portion located between said pair of edge portions, said middle portion having a middle surface portion composed of a second material, said second material having a second hardness, said second material being harder than said first material;

wherein each edge surface portion is replaceably mounted upon said roll.

9. The roll of claim 8, wherein each edge surface portion is mounted upon said roll using a threaded fastener.

10. The roll of claim 9, wherein each edge surface portion has a maximum mounted edge surface portion diameter, said maximum mounted edge surface portion diameter being capable of being varied by adjusting an amount of compression placed thereon by said threaded fastener.

11. An air press assembly roll, for sealing an air press pressure chamber in a papermaking machine, said roll having a pair of ends associated therewith, said roll comprising:

a pair of edge portions, each edge portion extending to one of said pair of ends, each edge portion having an edge surface portion composed of a first material, said first material having a first hardness; and a middle portion located between said pair of edge portions, said middle portion having a middle surface portion composed of a second material, said second material having a second hardness, said second material being harder than said first material;

wherein each edge surface portion is at least one of formed so as to have a crown and fastened under compression to create a bulge therein.

12. A method of dewatering a fiber web using an air press, said method comprising the steps of:

providing an air press for pressing a fiber web, said air press comprising:

at least one cap roll including a first cap roll; and at least one main roll including a first main roll, said first cap roll and said first main roll forming a first nip therebetween, each main roll having a pair of ends associated therewith, each main roll comprising:

a pair of edge portions, each edge portion extending to one of said pair of ends, each edge portion having an edge surface portion composed of a first material, said first material having a first hardness; and a middle portion located between said pair of edge portions, said middle portion having a middle surface portion composed of a second material, said second material having a second hardness, said second material being harder than said first material;

forming a seal between said pair of edge portions of said first main roll and said first cap roll; and feeding the fiber web through said first nip into said air press.

13. A papermaking machine for making a fiber web, the papermaking machine comprising:

a plurality of rolls for carrying the fiber web;

an air press for pressing a fiber web, said air press comprising:

a plurality of rolls including at least one first roll, each first roll having a pair of ends associated therewith, each first roll comprising:

a pair of edge portions, each edge portion extending to one of said pair of ends, each edge portion having an edge surface portion composed of a first material, said first material having a first hardness; and a middle portion located between said pair of edge portions, said middle portion having a middle surface portion composed of a second material, said second material having a second hardness, said second material being harder than said first material.

14. The papermaking machine of claim 13, wherein each said edge surface portion is configured to wear at a faster rate than said middle surface portion.

15. The papermaking machine of claim 14, wherein each edge surface portion has a maximum mounted edge surface portion diameter, said middle surface portion having a maximum mounted middle surface portion diameter, said maximum mounted edge surface portion diameter being greater than said maximum mounted middle surface portion diameter.

* * * * *